US008138943B2

(12) United States Patent
Kusko et al.

(10) Patent No.: US 8,138,943 B2
(45) Date of Patent: Mar. 20, 2012

(54) MEASUREMENT WHILE DRILLING PULSER WITH TURBINE POWER GENERATION UNIT

(76) Inventors: David John Kusko, Houston, TX (US); Gabor Vecseri, Houston, TX (US); Daniel Maurice Lerner, Missouri City, TX (US)

( * ) Notice: Subject to any disclaimer, the term of this patent is extended or adjusted under 35 U.S.C. 154(b) by 1395 days.

(21) Appl. No.: 11/657,939

(22) Filed: Jan. 25, 2007

(65) Prior Publication Data

US 2008/0179093 A1 Jul. 31, 2008

(51) Int. Cl.
*E21B 47/12* (2006.01)

(52) U.S. Cl. ..... 340/855.4; 340/853.1; 340/854.3; 367/83; 367/85

(58) Field of Classification Search ..... 340/854.3, 340/855.4, 853.1; 367/85, 83
See application file for complete search history.

(56) References Cited

U.S. PATENT DOCUMENTS

| | | | | | |
|---|---|---|---|---|---|
| 3,739,331 | A | * | 6/1973 | Godbey et al. | 367/142 |
| 3,770,006 | A | * | 11/1973 | Sexton et al. | 137/499 |
| 3,958,217 | A | | 5/1976 | Spinnler | |
| 4,134,100 | A | * | 1/1979 | Funke | 367/83 |
| 4,742,498 | A | | 5/1988 | Barron | |
| 4,839,870 | A | * | 6/1989 | Scherbatskoy | 367/83 |
| 4,847,815 | A | * | 7/1989 | Malone | 367/84 |
| 4,901,290 | A | | 2/1990 | Feld et al. | |
| 4,914,433 | A | * | 4/1990 | Galle | 340/854.4 |
| 5,040,155 | A | | 8/1991 | Feld et al. | |
| 5,103,430 | A | | 4/1992 | Jeter et al. | |
| 5,117,398 | A | | 5/1992 | Jeter | |
| 5,134,285 | A | | 7/1992 | Perry et al. | |
| 5,250,806 | A | | 10/1993 | Rhein-Knudsen et al. | |
| 5,402,068 | A | | 3/1995 | Meador et al. | |
| 5,461,230 | A | | 10/1995 | Winemiller | |
| 5,467,832 | A | | 11/1995 | Orban et al. | |
| 5,473,579 | A | | 12/1995 | Jeter | |
| 5,517,464 | A | | 5/1996 | Lerner et al. | |
| 5,586,083 | A | * | 12/1996 | Chin et al. | 367/84 |
| 5,740,126 | A | * | 4/1998 | Chin et al. | 367/84 |
| 5,802,011 | A | | 9/1998 | Winters et al. | |
| 5,804,820 | A | | 9/1998 | Evans et al. | |
| 5,901,113 | A | | 5/1999 | Masak et al. | |
| 6,002,643 | A | | 12/1999 | Tchakarov et al. | |
| 6,016,288 | A | | 1/2000 | Frith | |

(Continued)

FOREIGN PATENT DOCUMENTS

EP 0781422 B1 4/2000

(Continued)

*Primary Examiner* — Brian Zimmerman
*Assistant Examiner* — Amine Benlagsir
(74) *Attorney, Agent, or Firm* — Guerry L. Grune; ePatentmanager.com

(57) ABSTRACT

Disclosed are a system, device, and method for generating pulse signals that correlate to geological information in a wellbore. The system and method comprises a pulse generating device longitudinally and axially positioned within an annular drill collar flow channel such that the drilling fluid flows through the annular drill collar flow channel and the drilling fluid is guided into two sets of selectively reversible flow, upper and lower flow connecting channels, wherein the connecting channels are connected to an inner flow channel and the annular drill collar flow channel, and wherein the annular drill collar flow channel is acted upon by one or more flow throttling devices thereby transmitting signals. The device utilizes a turbine residing near and within proximity of a flow diverter that diverts drilling mud into and away from turbine blades such that the force of the drilling mud causes the turbine blades and the turbine to rotationally spin around a coil assembly.

42 Claims, 9 Drawing Sheets

U.S. PATENT DOCUMENTS

| | | | | |
|---|---|---|---|---|
| 6,050,349 | A * | 4/2000 | Rountree et al. | 175/40 |
| 6,057,784 | A | 5/2000 | Schaaf et al. | |
| 6,220,371 | B1 | 4/2001 | Sharma et al. | |
| 6,300,624 | B1 | 10/2001 | Yoo et al. | |
| 6,583,621 | B2 | 6/2003 | Prammer et al. | |
| 6,714,138 | B1 * | 3/2004 | Turner et al. | 340/854.3 |
| 6,970,398 | B2 * | 11/2005 | Lavrut et al. | 367/84 |
| 7,180,826 | B2 * | 2/2007 | Kusko et al. | 367/85 |
| 2001/0054417 | A1 * | 12/2001 | Kato et al. | 123/568.23 |
| 2004/0089475 | A1 | 5/2004 | Kruspe et al. | |
| 2005/0179263 | A1 * | 8/2005 | Johansen et al. | 290/1 R |
| 2006/0260806 | A1 * | 11/2006 | Moriarty | 166/250.1 |
| 2007/0262665 | A1 * | 11/2007 | Park | 310/80 |

FOREIGN PATENT DOCUMENTS

| | | | |
|---|---|---|---|
| EP | 0681090 | A2 | 12/2002 |
| GB | 2157345 | A | 10/1985 |
| WO | WO00/57211 | A1 | 9/2000 |
| WO | WO2004/044369 | A2 | 11/2004 |

* cited by examiner

MEASUREMENT WHILE DRILLING PULSER WITH TURBINE POWER GENERATION UNIT

FIELD OF DISCLOSURE

The current invention includes an apparatus and a method for creating a pulse within drilling fluid, generally known as drilling mud that is generated by selectively initiating flow driven bidirectional pulses. Features of the device include operating a flow throttling device (FTD) within a specially designed annular flow channel that reduces turbulent flow of the drilling fluid in a measurement-while-drilling device to provide for reproducible pressure pulses that are translated into low noise signals. The pulse is then received "up hole" as a series of signals that represent pressure variations which may be interpreted as gamma ray counts per second, azimuth, etc. by oilfield engineers and managers and utilized to increase yield in oilfield operations.

BACKGROUND

Current pulser technology includes pulsers that are sensitive to different fluid pump down hole pressures, and flow rates, and require field adjustments to pulse properly so that meaningful signals from these pulses can be received and interpreted uphole.

One of the advantages of the present disclosure is that the embodiments are that it decreases sensitivity to fluid flow rate or pressure within limits, does not require field adjustment, and is capable of creating recognizable, repeatable, reproducible, clean (i.e. noise free) fluid pulse signals using minimum power due to a unique flow throttling device (FTD) magneto-electric and turbine generated energy, and pilot flow channel design thereby helping to reduce MWD preparation for MWD drilling, a MWD field engineer at the well site continuously, and expenses associated with downtime. The annular flow channel is specifically designed such that primarily laminar flow exists in the area where the pulse occurs, acted upon by a flow throttling device thereby providing frequent essentially noise-free pulses and subsequent noise-free signals.

Additional pulsers with varying pressure amplitudes and/or frequencies are easily added to enable an exponential increase in the bit rate that is sent uphole. This will also allow the addition of more downhole sensors without losing formation resolution.

DESCRIPTION OF PRIOR ART

The present invention discloses a novel device for creating pulses in drilling fluid media flowing through a drill string. Devices currently in use require springs or solenoids to assist in creating pulses and are primarily located in the main drilling fluid flow channel. Current devices also require onsite adjustment of the flow throttling device (FTD) pulser according to the flow volume and fluid pressure and require higher energy consumption due to resistance of the fluid flow as it flows through an opened and throttled position in the drill collar.

The present inventive apparatus and assembly is also supported by a rigid centralizer centralized within the fluid flow. The centralizer provides centralization, support and shock dampening for the assembly. The pulser assembly includes a fishing head and fluid screen assembly attachment at the top end facing the flow.

The device provided by the current invention allows for the use of a flow throttling device that moves from an initial position to an intermediate and final position in both the upward and downward direction corresponding to the direction of the fluid flow. The present invention avoids the use of springs, the use of which are described in the following patents which are also herewith incorporated by reference in U.S. Pat. No. 3,958,217, U.S. Pat. No. 4,901,290, and U.S. Pat. No. 5,040,155.

U.S. Pat. No. 5,040,155 to Feld, et. al. describe a double guided fluid pulse valve that is placed within a tube casing making the valve independent of movement of the main valve body and free of fluctuations of the main valve body. The valve contains a pressure chamber with upwardly angled passages for fluid flow between the pressure chamber and the main valve body. Double guides ensure valve reliability in the horizontal position.

U.S. Pat. No. 5,473,579 to Jeter, et. al., describes a pulser that utilizes a servo valve and spring acting upon each other to urge a signal valve to move axially within a bore with signal assistance coming from a counter balance compensator device.

U.S. Pat. No. 5,117,398 to Jeter describes a pulser device that uses electromagnetically opened latches that mechanically hold the valve in the closed or open position, not allowing movement, until a signal is received and the latches are electronically released.

U.S. Pat. No. 6,002,643 by Tchakarov, et al., describes a pulser device in which a bi-directional solenoid contains a first and second coil and a rod extending within the coils used to actuate a poppet valve creating bi-directional pressure pulses. Orifices to permit the flow of drilling fluid to be acted upon by the piston assembly within the main body of the pulser tool and a pressure actuated switch to enable the electronics of the control device to act upon the pulser tool.

U.S. Pat. No. 4,742,498 to Barron describes a pulser device that has the piston that is acted upon by the drilling fluid and is allowed seating and unseating movement by use of springs and an omni directional solenoid.

U.S. Pat. No. 6,016,288 to Frith discloses a servo driven pulser which actuates a screw shaft which turns and provides linear motion of the valve assembly. All components except the shaft are within a sealed compartment and do not come in contact with the drilling fluid.

U.S. Pat. No. 5,802,011 to Winters, et al., that describes a solenoid driven device that pivots a valve that enters and leaves the annular drilling fluid flow blocking and unblocking the fluid flow intermittently.

U.S. Pat. No. 5,103,430 to Jeter, et al., describes a two chamber pulse generating device that creates fluid chambers above and below a poppet valve that is servo driven. Pressure differential is detected on either side of the poppet through a third chamber and the servo is urged to move the poppet in order to stabilize the pressure differential.

U.S. Pat. No. 5,901,113 to Masak, et al., describes a measurement while drilling tool that utilizes inverse seismic profiling for identifying geologic formations. A seismic signal generator is placed near the drill bit and the generated known signals are acted upon by the geologic formations and then read by a receiver array.

U.S. Pat. No. 6,583,621 B2 to Prammer, et al., describes a magnetic resonance imaging device comprising of a permanent magnet set within a drill string that generates a magnetic flux to a sending antennae that is interpreted up hole.

U.S. Pat. No. 5,517,464 to Lerner, et al., describes a pulse generating device utilizing a flow driven turbine and modulator rotor that when rotated creates pressure pulses.

U.S. Pat. No. 5,467,832 to Orban, et al., describes a method for generating directional downhole electromagnetic or sonic vibrations that can be read up hole utilizing generated pressure pulses.

U.S. Pat. No. 5,461,230 to Winemiller, describes a method and apparatus for providing temperature compensation in gamma radiation detectors in measurement while drilling devices.

U.S. Pat. No. 5,402,068 to Meador, et. al., describes a signal generating device that is successively energized to generate a known electromagnetic signal which is acted upon by the surrounding environment. Changes to the known signal are interpreted as geological information and acted upon accordingly.

U.S. Pat. No. 5,250,806 to Rhein-Knudsen, et al., describes a device wherein the gamma radiation detectors are placed on the outside of the MWD device to physically locate them nearer to the drill collar in order to minimize signal distortion. U.S. Pat. No. 5,804,820 to Evans, et al., describes a high energy neutron accelerator used to irradiate surrounding formations that can be read by gamma radiation detectors and processed through various statistical methods for interpretation.

U.S. Pat. No. 6,057,784 to Schaaf, et al., describes a measurement while drilling module that can be placed between the drill motor and the drill bit situating the device closer to the drill bit to provide more accurate geological information.

U.S. Pat. No. 6,220,371 B1 to Sharma, et al., describes a downhole sensor array that systematically samples material (fluid) in the drill collar and stores the information electronically for later retrieval and interpretation. This information may be transmitted in real time via telemetry or other means of communication.

U.S. Pat. No. 6,300,624 B1 to Yoo, et al., describes a stationary detection tool that provides azimuth data, via radiation detection, regarding the location of the tool.

U.S. Pat. No. 5,134,285 to Perry, et al., describes a measurement while drilling tool that incorporates specific longitudinally aligned gamma ray detectors and a gamma ray source.

U.S. Application No. 2004/0089475 A1 to Kruspe, et. al., describes a measurement while drilling device that is hollow in the center allowing for the drilling shaft to rotate within while being secured to the drill collar. The decoupling of the device from the drill shaft provides for a minimal vibration location for improved sensing.

U.S. Pat. No. 6,714,138 B1 to Turner, et. al., describes a pulse generating device which incorporates the use of rotor vanes sequentially moved so that the flow of the drilling fluid is restricted so as to generate pressure pulses of known amplitude and duration.

G.B. Application No. 2157345 A to Scott, describes a mud pulse telemetry tool which utilizes a solenoid to reciprocally move a needle valve to restrict the flow of drilling fluid in a drill collar generating a pressure pulse.

International Application Number WO 2004/044369 A2 to Chemali, et. al., describes a method of determining the presence of oil and water in various concentrations and adjusting drilling direction to constantly maintain the desired oil and water content in the drill string by use of measuring fluid pressure. The fluid pressure baseline is established and the desired pressure value is calculated, measured and monitored.

International Publication Number WO 00/57211 to Schultz, et. al., describes a gamma ray detection method incorporating the use of four gamma ray sondes to detect gamma rays from four distinct areas surrounding a bore hole.

European Patent Application Publication Number 0681 090 A2 to Lerner, et. al., describes a turbine and rotor capable of restricting and unrestricting the fluid flow in a bore hole thereby generating pressure pulses.

European Patent Specification Publication Number EP 0 781 422 B1 to Loomis, et. al. describes utilizing a three neutron accelerator and three detectors sensitive to specific elements and recording device to capture the information from the three detectors.

SUMMARY

The present disclosure involves the placement of a Measurement-While-Drilling (MWD) pulser device including a flow throttling device located within a drill collar in a wellbore incorporating drilling fluids for directional and intelligent drilling.

The present disclosure will now be described in greater detail and with reference to the accompanying drawing. With reference now to FIG. 1, the device illustrated produces pressure pulses in drilling fluid flowing through a tubular drill collar and an upper annular drill collar flow channel. The flow guide is secured to the inner diameter of the drill collar. The centralizer secures the lower portion of the pulse generating device and is comprised of a non-magnetic, rigid, wear resistant material with outer flow channels.

Specifically, the pulser assembly provides essentially four outer flow channels that allow fluid, such as drilling mud, to flow. These are defined as the upper annular, the middle annular, lower annular, and centralizer annular collar flow channels. The inner lower and inner middle flow channels direct the drilling mud flow to the pulser assembly within the MWD device. Annular flow of the drilling fluid, by the flow guide and flow throttling device, is essentially laminar, and pulse signals are generated that are more detectable. Incorporation of a method and system of magnetic coupling, a concentrically located turbine, inductive coil for electrical power generation, bellows design and reduced pressure differential, collectively significantly reduce battery energy consumption when compared with conventional devices.

In a preferred embodiment, the MWD device utilizes a turbine residing near and within the proximity of a flow diverter. The flow diverter diverts drilling mud in an annular flow channel into and away from the turbine blades such that the force of the drilling mud causes the turbine blades and turbine to rotationally spin around an induction coil. The induction coil generates electrical power for operating the motor and other instrumentation mentioned previously. The motor is connected to the pilot actuator assembly via a drive shaft. The pilot actuator assembly comprises a magnetic coupling and pilot assembly. The magnetic coupling comprises outer magnets placed in direct relation to inner magnets located within the magnetic pressure cup or magnetic coupling bulkhead. The magnetic coupling translates the rotational motion of the motor, via the outer magnets to linear motion of the inner magnets via magnetic polar interaction. The linear motion of the inner magnets moves the pilot assembly, comprising the pilot shaft, and pilot valve, linearly moving the pilot into the pilot seat. This action allows for closing the pilot seat, pressurizing the flow throttling device, closing the flow throttling device orifice, thereby generating a pressure pulse. Further rotation of the motor, drive shaft, via the magnetic coupling, moves the pilot assembly and pilot away from the pilot seat, depressurizing the flow throttling device sliding pressure chamber and opening the flow throttling device and completing the pressure pulse. Identical operation of the pilot into and out of the pilot seat orifice can also be accomplished via linear to linear and also rotation to rotation motions of the outer magnets in relation to the inner magnets such that, for example, rotating the outer magnet to rotate the inner magnet to rotate a (rotating) pilot valve causing changes in the pilot pressure, thereby pushing the FTD (flow throttling device) up or down.

Unique features of the pulser include the combination of middle and lower inner flow channels, flow throttling device, bellows, and upper and lower flow connecting channels possessing angled outlet openings that helps create signals transitioning from both the sealed (closed) and unsealed (open) positions. Additional unique features include a flow guide for transitional flow and a sliding pressure chamber designed to allow for generation of the pressure pulses. The flow throttling device slides axially on a pulser guide pole being pushed by the pressure generated in the sliding pressure chamber when the pilot is in the seated position. Additional data (and increased bit rate) is generated by allowing the fluid to quickly back flow through the unique connecting channel openings when the pilot is in the open position. Bi-directional axial movement of the poppet assembly is generated by rotating the motor causing magnets to convert the rotational motion to linear motion which opens and closes the pilot valve. The signal generated provides higher data rate in comparison with conventional pulsers because of the bi-directional pulse feature. Cleaner signals are transmitted because the pulse is developed in near-laminar flow within the uniquely designed flow channels and a water hammer effect due to the small amount of time required to close the flow throttling device.

The method for generating pressure pulses in a drilling fluid flowing downward within a drill string includes starting at an initial first position wherein a pilot (that can seat within a pilot seat which resides at the bottom of the middle inner flow channel) within a lower inner flow channel is not initially engaged with the pilot seat. The pilot is held in this position with the magnetic coupling. The next step involves rotating the motor causing the magnetic fields of the outer and inner magnets to move the pilot actuator assembly thereby moving the pilot into an engaged position with the pilot seat. This motion seals a lower inner flow channel from the middle inner flow channel and forces the inner fluid into a pair of upper connecting flow channels, expanding the sliding pressure chamber, causing a flow throttling device to move up toward a middle annular flow channel and stopping before the orifice seat, thereby causing a flow restriction. The flow restriction causes a pressure pulse or pressure increase transmitted uphole. At the same time, fluid remains in the exterior of the lower connecting flow channels, thus reducing the pressure drop across the, pilot seat. This allows for minimal force requirements for holding the pilot in the closed position. In the final position, the pilot moves back to the original or first position away from the pilot orifice while allowing fluid to flow through the second set of lower connecting flow channels within the lower inner flow channel. This results in evacuating the sliding pressure chamber as fluid flows out of the chamber and back down the upper flow connecting channels into the middle inner flow channel and eventually into the lower inner flow channel. As this occurs, the flow throttling device moves in a downward direction along the same direction as the flowing drilling fluid until motionless. This decreases the FTD created pressure restriction of the main drilling fluid flow past the flow throttling device orifice completing the pulse.

An alternative embodiment includes the motor connected to a drive shaft through a mechanical device such as a worm gear, barrel cam face cam or other mechanical means for converting the rotational motion of the motor into linear motion to propel the pilot actuator assembly.

DETAILED DESCRIPTION

The present invention will now be described in greater detail and with reference to the accompanying drawing. With reference now to FIG. 1, the device illustrated produces pressure pulses in drilling fluid flowing through a tubular drill collar and upper annular drill collar flow channel. The flow guide is secured to the inner diameter of the drill collar. The centralizer secures the lower portion of the pulse generating device and is comprised of a non-magnetic, rigid, wear resistant material with outer flow channels.

In the open position the pilot is not engaged within the pilot seat allowing flow through the pilot seat. In the open position, fluid flows past the fishing head through the mud screen where a portion of the fluid flows through the pilot assembly. Fluid within the fishing head assembly flows through the upper orifice between the fishing head inner screen and the guide pole channel to allow for flow within the guide pole channel in the center of the pulser guide pole.

In the closed position the pilot actuator assembly moves the pilot until it is in closed position with the pilot seat where no flow through can occur. The pilot actuator assembly is the only portion of the shaft that moves the pilot in a translational or rotational direction. The pilot orifice and pilot seat must be related to ensure hydraulic pressure differential which allows proper movement of the flow throttling device.

The lower inner flow channel and the lower flow connecting channels are effectively sealed from the pilot channel so that their fluid flow is completely restricted from the interior of the FTD. As this sealing is achieved, fluid still enters the inner flow channel via the connecting channel, thus almost equalizing the pressure across the pilot assembly. The downward flow through the drill collar causes the fluid to flow past the fishing head and mud screen assembly. Fluid then flows into the middle inner flow channel through the upper flow connecting channels and into the sliding pressure chamber filling and expanding the sliding pressure chamber, causing the flow throttling device to rise along the pulser guide pole. This effectively restricts the middle annular drill collar flow channel from the lower annular drill collar flow channel, thereby generating a positive signal pulse at the throttle zone for pulse generation and corresponding signal transmittal.

These conditions provide generation of pulses as the flow throttling device reaches both the closed and opened positions. The present invention allows for several sized FTD's (FIG. 2AD) to be placed in a drilling collar, thereby allowing for different flow restrictions and/or frequencies which will cause an exponential increase in the data rate that can be transmitted up hole.

Positioning of the pulser assembly within the drill collar and utilizing the flow guide significantly decreases the turbulence of the fluid. The linear motion of the flow throttling device axially along the pulser guide pole is both up and down (along a bi-axial direction).

Conventional pulsers require adjustments to provide a consistent pulse at different pressures and flow rates. The signal provided in conventional technology is by a pulse that can be received up hole by use of a pressure transducer that is able to differentiate pressure pulses (generated downhole). These uphole pulses are then converted into useful signals providing information for the oilfield operator, such as gamma ray counts per second, azimuth, etc. Another advantage of the present invention is the ability to create a clean (essentially free of noise) pulse signal that is essentially independent of the fluid flow rate or pressure within the drill collar. The present invention thereby allows for pulses of varying amplitudes (in pressure) and frequencies to increase the bit rate. Addition of more than one pulser assemblies would lead to an exponential increase in the data bit rate received uphole.

The connecting flow channels allow for equalization of the pressure drop across the pilot to be matched by the flow throttling device (FTD) as a servo-amplifier. The primary pressure change occurs between the inner middle and inner lower flow channels providing a pressure drop created by the flow throttling device restricting the annular flow through the throttle zone. The pressure drop across the pilot is the only force per unit area that must be overcome to engage or disengage the pilot from the seated position and effect a pulse. This pressure drop across a minimal cross-sectional area of the pilot ensures that only a small force is required to provide a pulse in the larger flow area of the FTD.

While the present invention has been described herein with reference to a specific exemplary embodiment thereof, it will be evident that various modifications and changes may be made thereto without departing from the broader spirit and scope of the invention as set forth in the appended claims. The specification and drawings included herein are, accordingly to be regarded in an illustrative rather than in a restrictive sense.

Magnetic coupling alleviates the concern for a rotary seal or bellow type seal which all other MWD tools have and has caused flooding and maintenance issues.

DETAILED DESCRIPTION OF THE DRAWINGS

The detailed description refers to the placement of a Measurement-While-Drilling (MWD) device [100] located within a drill collar [29] in a well bore incorporating fluid generally known as drilling mud [115]. Descriptions of the present disclosure are incorporated within the aforementioned description. The MWD [100] is described in greater detail referring specifically to the accompanying figures.

Figure 1:
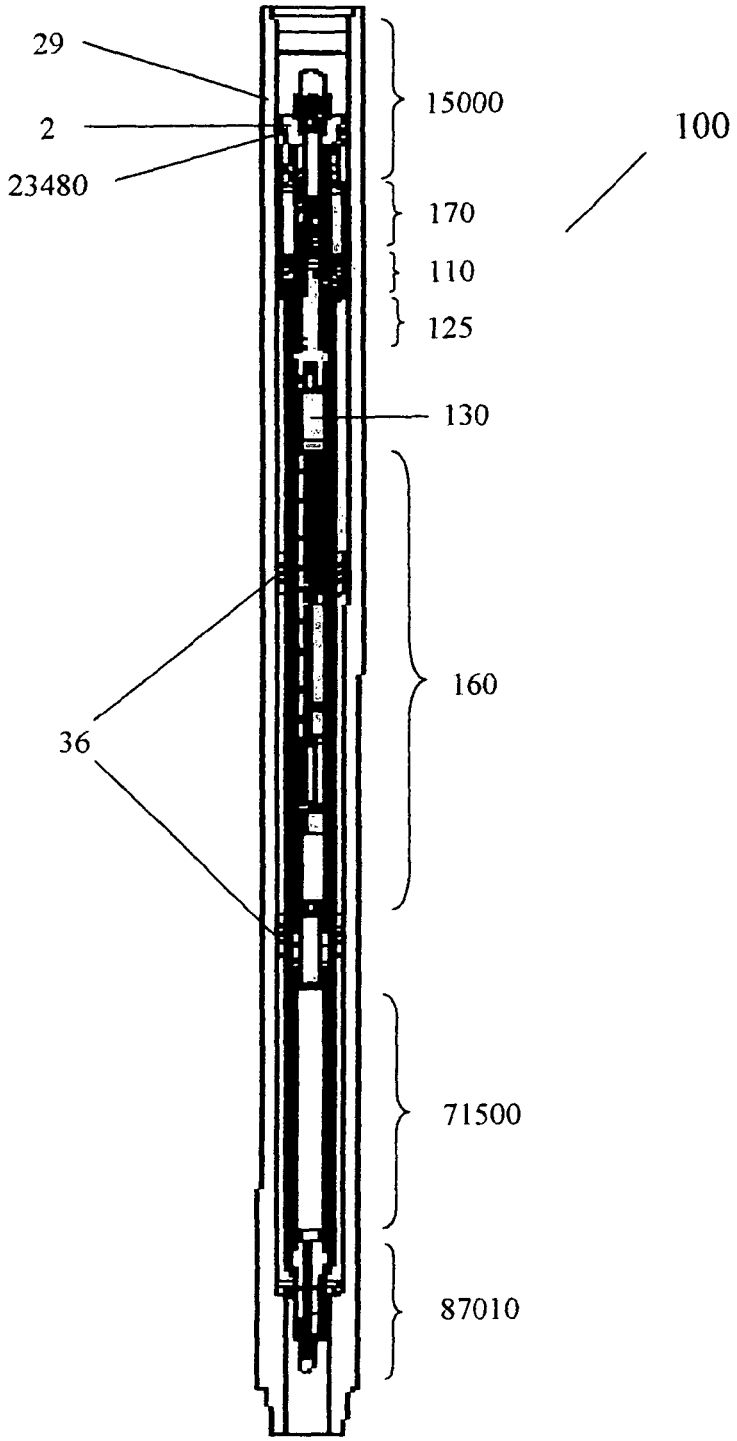
FIG. 1 is an overview of an MWD.

With reference now to FIG. 1, the device illustrated produces pressure pulses in drilling fluid flowing through a tubular drill collar [29] and upper annular drill collar flow channel [2]. The flow guide [23480] is secured to the inner diameter of the drill collar [29]. The centralizer [36] secures the lower portion of the MWD and is comprised of a non-magnetic, rigid, wear resistant material with outer flow channels. Major assemblies of the MWD are shown as the fishing head assembly [15000], flow throttling device and pulser actuator assembly complete the pulser assembly [170], turbine [110] and coil assembly [125], motor [130], various instrumentation [160], battery [71500], and stinger [87010].

Figure 2A:
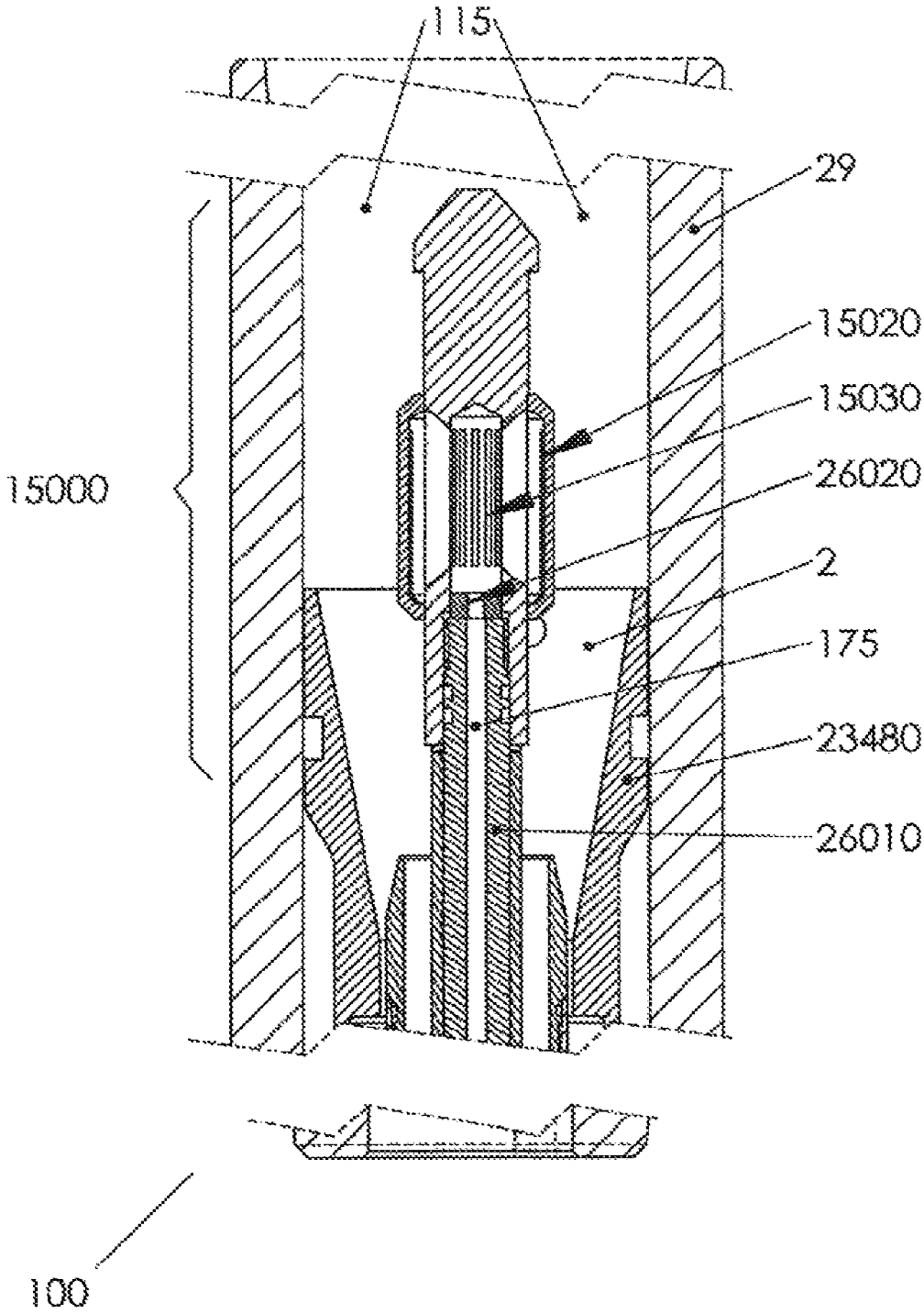
FIG. 2A is a cut-away longitudinal sectional view of the fishing head assembly.

FIG. 2A details the open position, drilling mud [115] flows past the fishing head assembly [15000] and fishing head outer screen [15020] where a portion of the drilling mud [115] flows through the fishing head inner screen [15030]. Drilling mud [115] within the fishing head assembly [15000] flows through the upper orifice [26020] between the fishing head inner screen [15030] and the guide pole channel [175] to allow for flow within the guide pole channel [175] in the center of the pulser guide pole [26010].

These conditions provide generation of a pulse as the flow throttling device reaches both the closed and opened positions. The present invention allows for several sized flow throttling devices (FIG. 1) to be placed in a drilling collar, thereby allowing for pressure pulse amplitudes and/or frequencies and consequential exponential increases in the data rate.

Figure 2B:
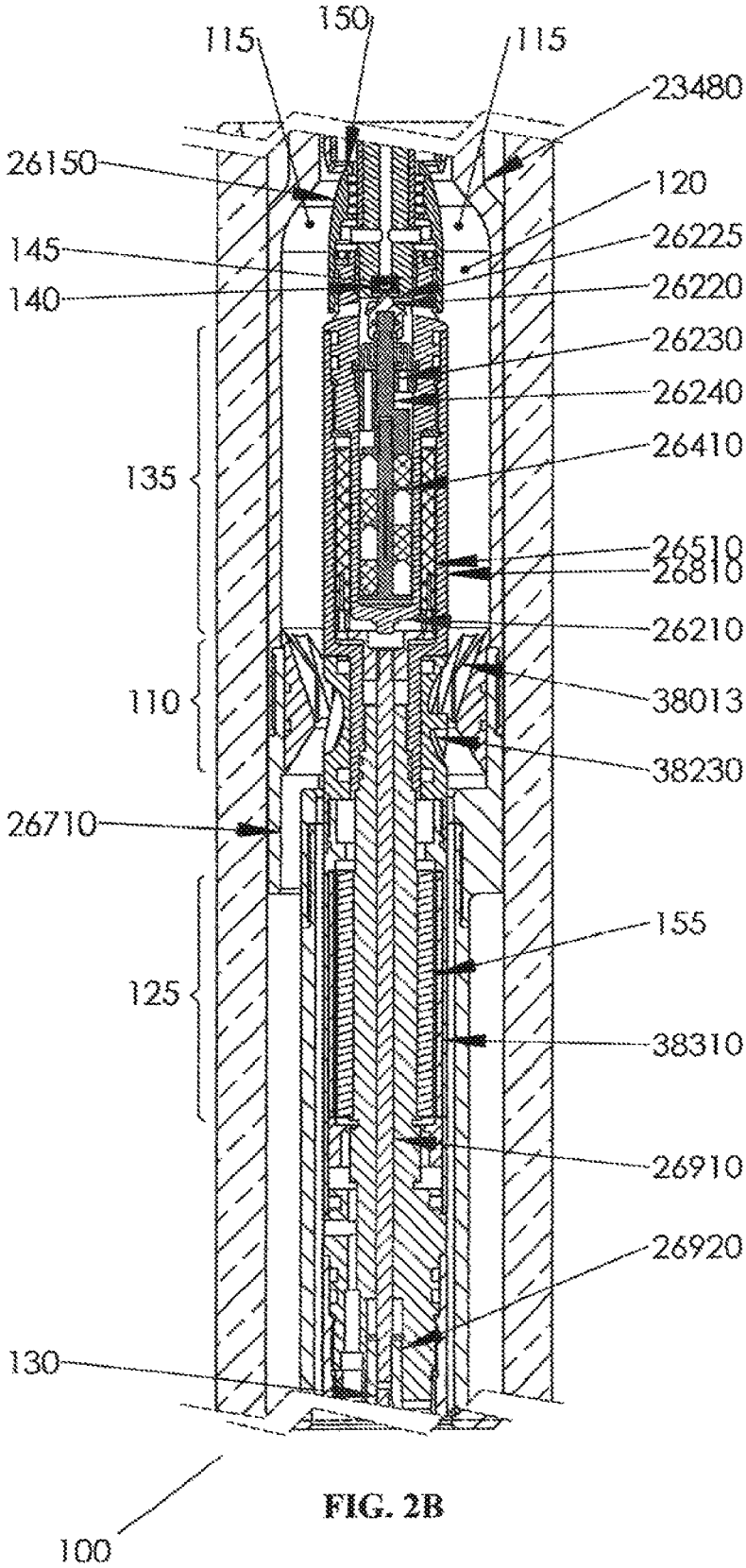
FIG. 2B is a continuation of the cross-sectional view shown in FIG. 2A and including details of the pulser, turbine, coil and motor assemblies.

In an embodiment, FIG. 2B describes the MWD device [100] which utilizes a turbine [110] residing near and within proximity of a flow diverter [38013]. The flow diverter [38013] diverts drilling mud [115] in an lower annular drill collar flow channel [120] into and away from the turbine blade [38230] such that the force of the drilling mud [115] causes the turbine blade [38230] and turbine assembly [110] to rotationally spin around a coil assembly [125]. The coil assembly [125] generates electrical power for operating the motor [130] and other instrumentation [160] (FIG. 1). The motor [130] comprises a worm gear [26920], a drive shaft [26910] centrally located between the motor [130] and the outer magnets [26510] and mechanically coupled to both. Located in a position external to the magnetic pressure cup [26210] are outer magnets [26510] placed in relation to inner magnets [26410] located in a position inside the magnetic pressure cup [26210] forming a magnetic coupling. The coupling is for translating the rotational motion of the motor [130], and outer magnets [26510] to linear motion for the inner magnets [26410] via a magnetic polar interaction. The linear motion of the inner magnets [26410] help move the pilot actuator assembly [135], comprised of the rear pilot shaft [26240], front pilot shaft [26230] and pilot [26220], linearly moving the pilot [26220] into the pilot seat [140] closing the pilot seat orifice [145] lifting the flow throttling device [26150] into the flow throttling device orifice [150] thereby generating a pressure pulse. A pilot valve [26225] is comprised of the pilot [26220], the pilot seat [140] and the pilot seat orifice [145]. Further rotation of the motor [130], drive shaft [26910] and outer magnets [26510] move the pilot actuator assembly [135] and pilot [26220] away from the pilot seat [140] causing the flow throttling device [26150] to move away from the flow throttling orifice [150] thereby generating a negative pressure pulse. The inner magnets [26410] are isolated from the drilling mud [115] via a double rolling bellows [26310] which is described further in FIG. 4. A pulse in the drilling mud [115] is sensed by the uphole system and communicated, optionally with wireless devices, to a computer [165](not shown) for interpretation.

Additionally, description of FIG. 2B shows the turbine [110] which resides within the lower annular flow channel [120] of the flow guide [23480]. The lower annular flow channel [120] has diverting vanes [38013] that direct the flow of the drilling mud [115] through and around the surface of the turbine [110]. The diverter vanes [38013] project from the flow guide extension [26710] in a fashion so as to direct the flow of the drilling mud [115] to move the turbine blade

[38230] and attached turbine assembly [110] thereby changing the linear motion of the drilling mud [115] into rotational motion of the turbine assembly [110]. The turbine shroud [38310] contains magnets [155] that rotate with the motion of the turbine [110] around a coil assembly [125] causing electrical power to be generated for the operation of the motor [130]. The outside diameter of the turbine blade [38230] is smaller than the flow guide extension [26710] inner diameter, thereby allowing the turbine [110] to be removed concurrently with the pulser housing [26810] from the MWD device [100]. The configuration of the turbine blade [38230] and flow diverter [38013] may be of various angles depending on the drilling conditions.

Additionally the electrical power is used for operation of various instrumentation [160] (FIG. 1) such as accelerometers, photo-multiplier tubes (PMT), crystal gamma ray scintillators and other useful instrumentation. Excess power provides charging for the onboard battery [71500](FIG. 1) for storage and use under certain conditions where the coil assembly [125] does not generate enough power to operate the MWD device [100] under no flow conditions.

The velocity and consistency of the drilling mud [115] traveling through the annular flow channel [120] may vary due to wellbore conditions generally providing varying forces on the turbine [110]. The varying forces cause the turbine [110] to spin at different velocities exhibiting a wide range of power to be developed by the coil assembly [125]. Fluctuations in the power are regulated through an electrical regulation circuit.

The motor [130] receives a signal from a computer [165] (not shown) that is onboard the MWD device [100] to move the drive shaft [26910]. The motor [130] may be synchronous, asynchronous or stepper and is activated to fully rotate or to rotationally increment various degrees, depending on the wellbore conditions or the observed signal intensity and/or duration.

Figure 2C:
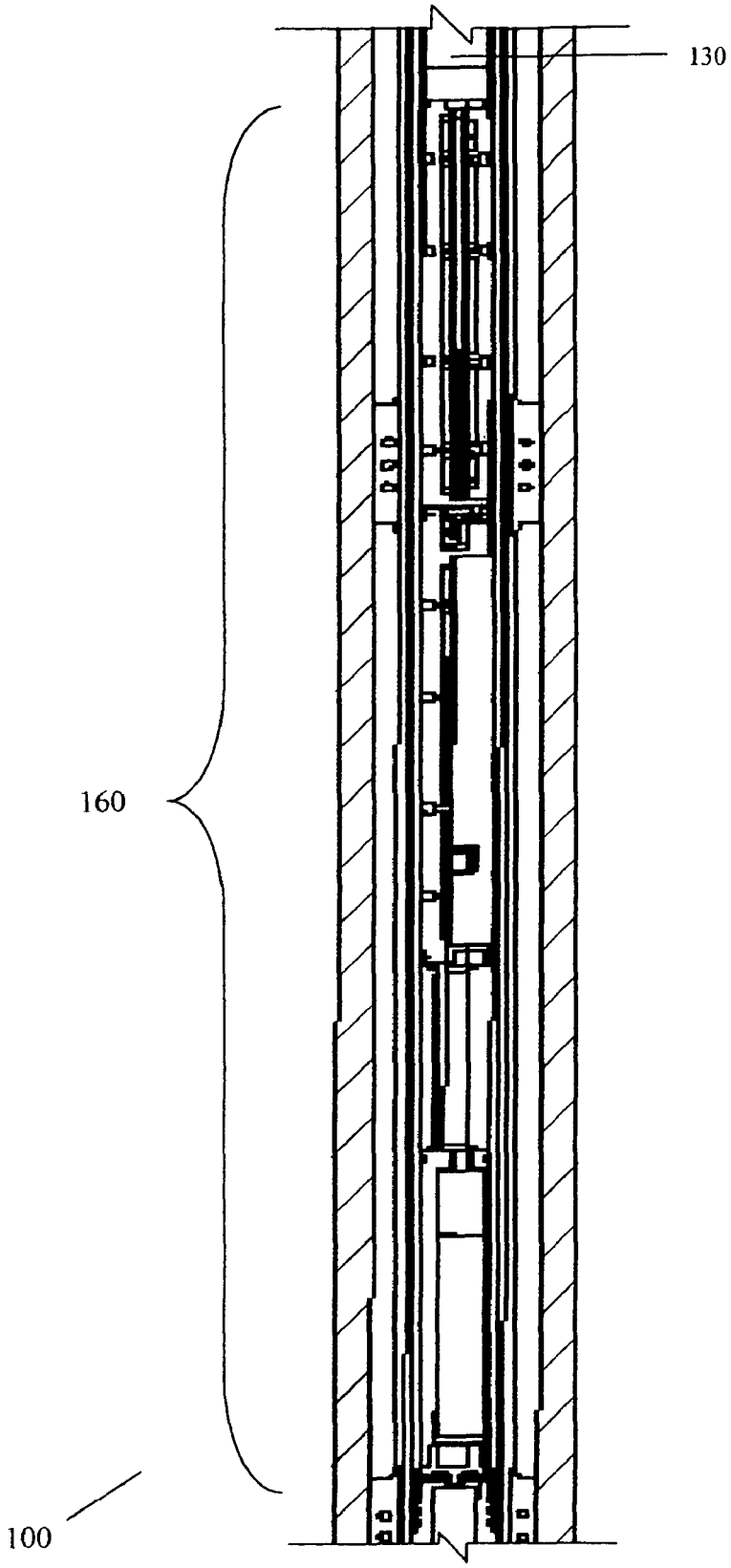
FIG. 2C is a continuation of FIG. 2B, illustrating more of the MWD components, particularly the various instrumentation, starting with the motor assembly through the gamma ray chassis end plug.

FIG. 2C shows the section of the MWD device [100] containing various instrumentation [160], starting with motor [130] standard instrumentation, known to those skilled in the art, may include but are not limited to accelerometers, photo-multiplier tubes (PMT), crystal gamma ray scintillators and other useful instrumentation.

Figure 2D:
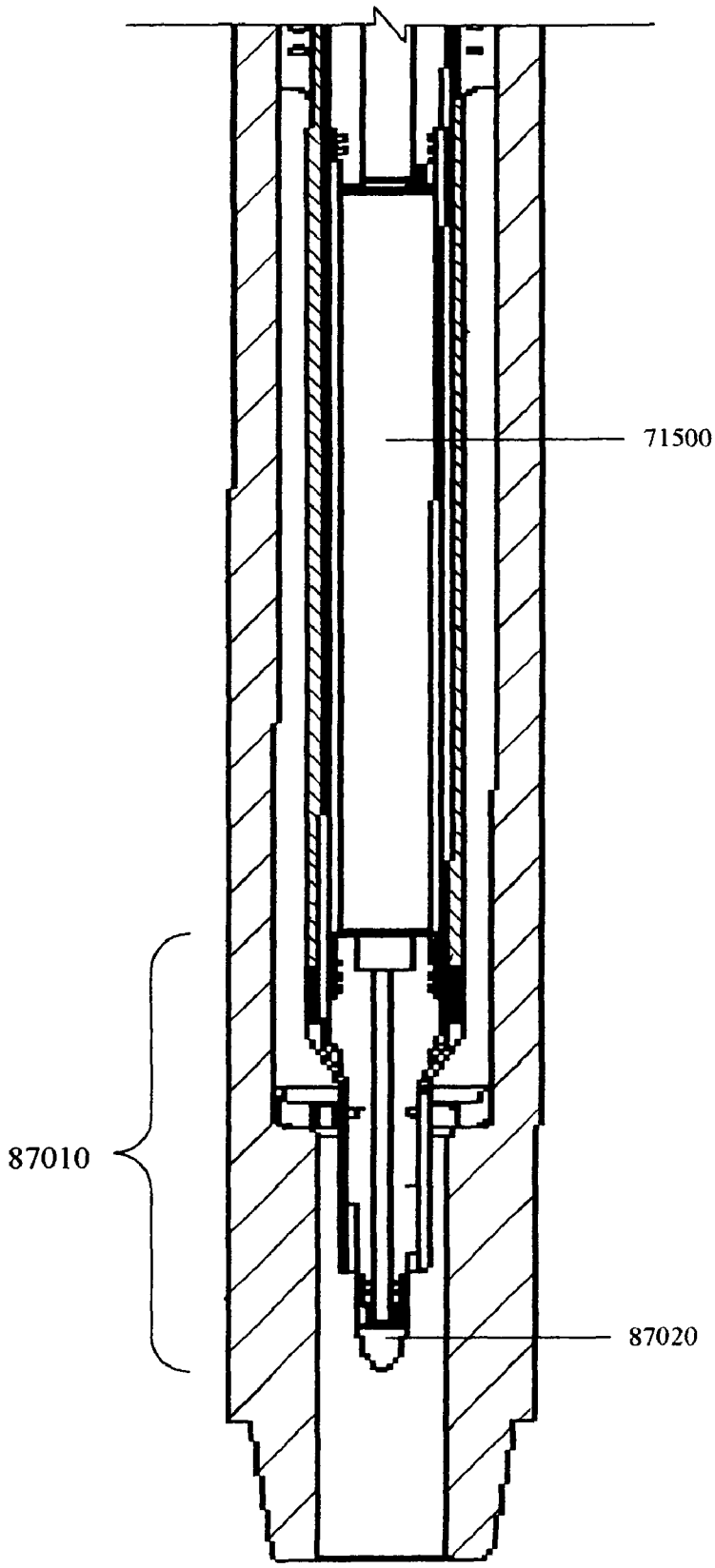
FIG. 2D completes the MWD component description from the gamma ray end plug through the stinger nose.

FIG. 2D shows the final section of the MWD device [100] including the battery [71500], the stinger [87010] and the stinger nose [87020].

Positioning of the flow throttling device assembly [26150] (FIG. 3) within the drill collar [29] and utilizing the flow guide [23480] significantly decreases the turbulence of the drilling mud [115]. The force required to move the pilot [26220] into or out of the pilot seat [140] is minimal. Operational power consumption to retain the pilot in any position is less than current MWD technology. The linear motion of the flow throttling device [26150] axially along the pulser guide pole [26010] is both up and down (along a bi-axial direction).

Figure 3:
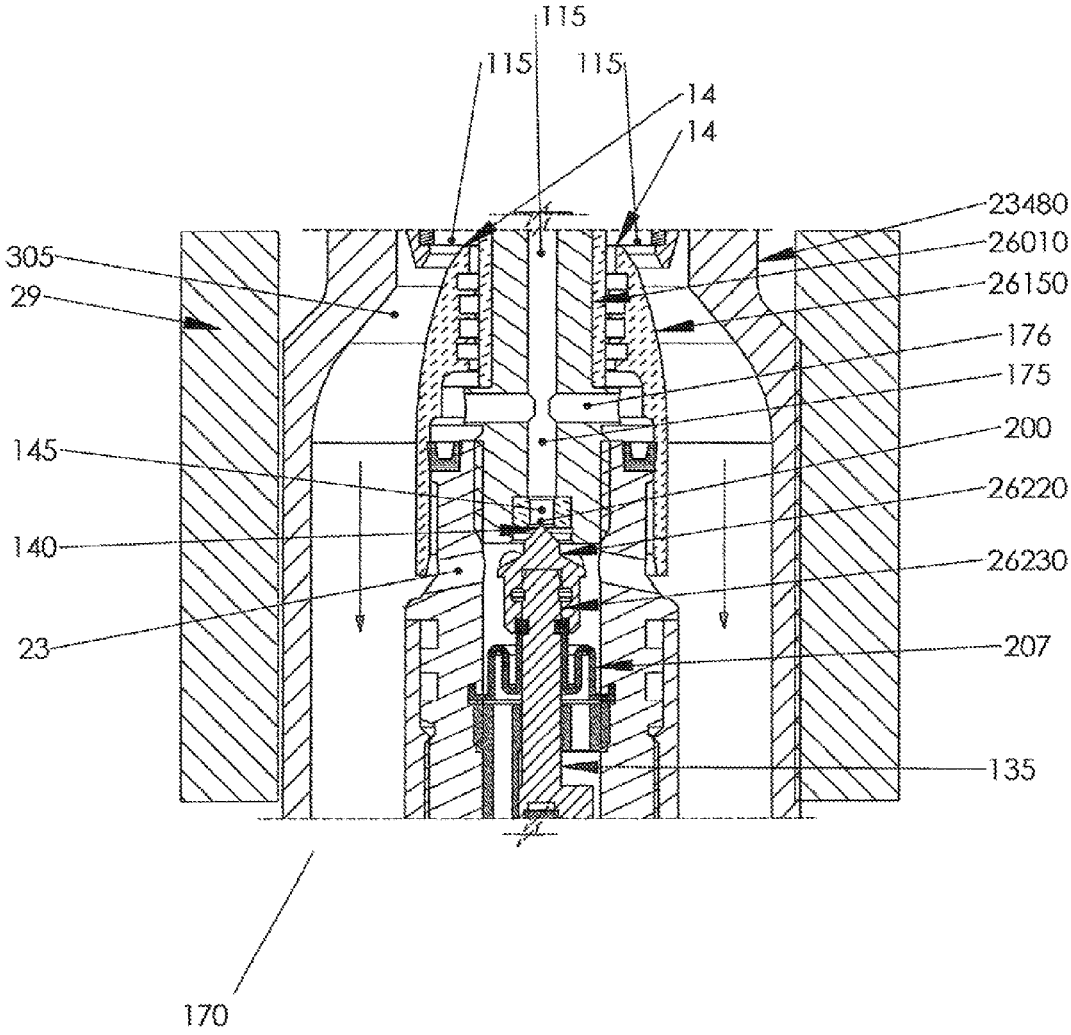
FIG. 3 describes the pulser system operation.

FIG. 3 shows the pulser assembly [170] within a drill collar [29] when in the closed position the pilot actuator assembly [135] moves the pilot [26220] until it is in closed position with the pilot seat [140] where. no flow through can occur. The front pilot shaft [26230] which is adjacent to the bellows [207] is the only portion of the pilot actuator assembly that moves the pilot [26220] in a translational or rotational direction.

For FIG. 3, when the pilot is in closed position, the guide pole channel [175] and the connecting channels [23] are effectively sealed so that drilling mud [115] flow is completely restricted through the pilot seat orifice [145]. As this sealing is achieved, drilling mud [115] still enters both the guide pole channel [175] to the orifice chamber [200] and separately, the connecting channels [23], thus almost equalizing the pressure across the pilot [26220]. The drilling mud [115] flows through the guide pole channel [175] causing the flow throttling device [26150] to rise along the pulser guide pole [26010]. This effectively restricts the middle annular drill collar flow channel [305] from the lower annular drill collar flow channel [120], thereby generating a positive signal pulse at the throttle zone for pulse generation [14] and corresponding signal transmittal.

Figure 4:
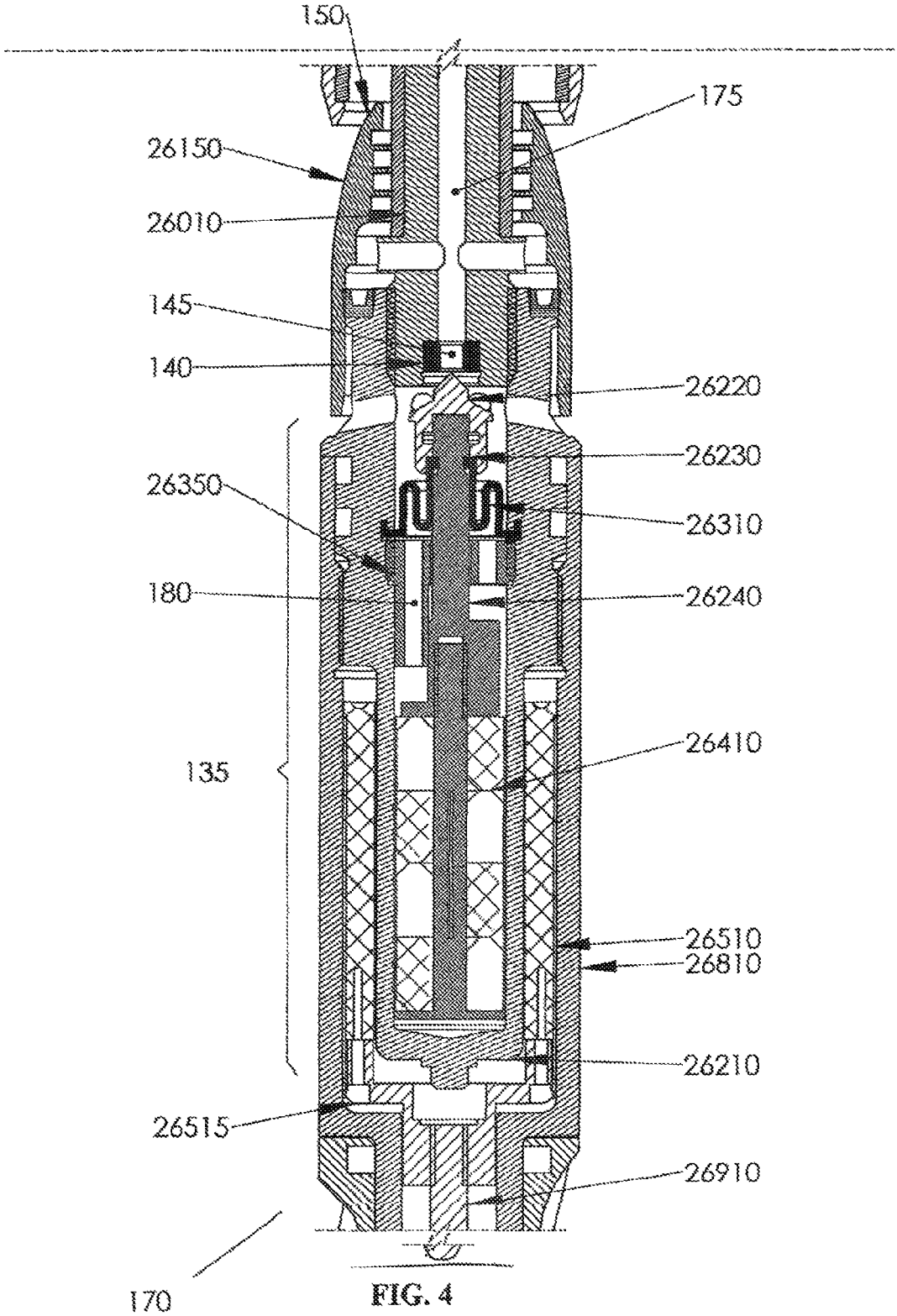
FIG. 4 describes the operation of the magnetic coupling and how the pilot is actuated.

In FIG. 4 starting from an outside position and moving toward the center of the pulser assembly [170] comprising a pulser housing [26810] of a non-magnetic material, a magnetic pressure cup [26210], which is also comprised of a non-magnetic material, and encompassed by the outer magnets [26510]. The outer magnets [26510] may comprise several magnets, or one or more components of magnetic or ceramic material exhibiting several magnetic poles within a single component. Additionally the magnetic pole positions may be customizable, depending on the drilling conditions, to achieve a clear pressure signal. The outer magnets are housed in an outer magnet housing [26515] that is attached to the drive shaft [26910]. Within the magnetic pressure cup [26210] is housed the inner magnet assembly, that contains the pilot actuator assembly [135] comprised of the rear pilot shaft [26240] linearly engaged in a front pilot shaft [26230], which is moved longitudinally in the center of the pulser assembly [170]. Within the magnetic pressure cup [26210] is the rear pilot shaft [26240], also comprised of non-magnetic material. The outer magnets [26510] and the inner magnets [26410] are placed so that the magnetic polar regions interact, attracting and repelling as the outer magnets [26510] are moved about the inner magnets [26410]. Using the relational combination of magnetic poles of the moving outer magnets [26510] and inner magnets [26410] causes the inner magnets [26410] with the rear pilot shaft [26240], to move the pilot actuator assembly [135] linearly and interactively as a magnetic field coupling. The linear motion is along the rear pilot shaft [26240], through the front pilot shaft [26230], the bellows [26310] and to the pilot [26220] thereby opening or closing the passage between the pilot [26220] and the pilot seat [140]. The use of outer magnets [26510] and inner magnets [26410] to provide movement from rotational motion to linear motion also allows the motor [130](FIG. 2B) to be located in an air atmospheric environment in lieu of a lubricating fluid [180] environment inside the magnetic pressure cup [26210]. This also allows for a decrease in the cost of the motor [130](FIG. 2B), decreased energy consumption and subsequently decreased cost of the actual MWD device [100] (FIG. 1). It also alleviates the possibility of flooding the tool instead of the use of a moving mechanical seal.

Switching fields between the outer magnets [26510] and the inner magnets [26410] provides a magnetic spring like action that allows for pressure relief by moving the pilot [26220] away from the pilot seat [140] thereby regulating the pulse magnitude. The same figure shows the guide pole [26010] the guide pole channel [175] and the orifice chamber [200] in the proximity of the pilot seat [140]. Additionally the outer magnets [26510] [26410] operate in the lower pressure of the pulser housing [26810] as opposed to the higher pressure within the magnetic pressure cup allowing for a greatly reduced need in the amount of energy required by the motor to longitudinally move the pilot actuator assembly [135].

The front pilot shaft [26230] passes through the anti-rotation block [26350] located below the bellows [26310]. The anti-rotation block [26350] located near the bellows [26310]

is secured to the inside of the magnetic pressure cup [26210] and restricts the rotational movement of the front pilot shaft [26230].

Figure 5:
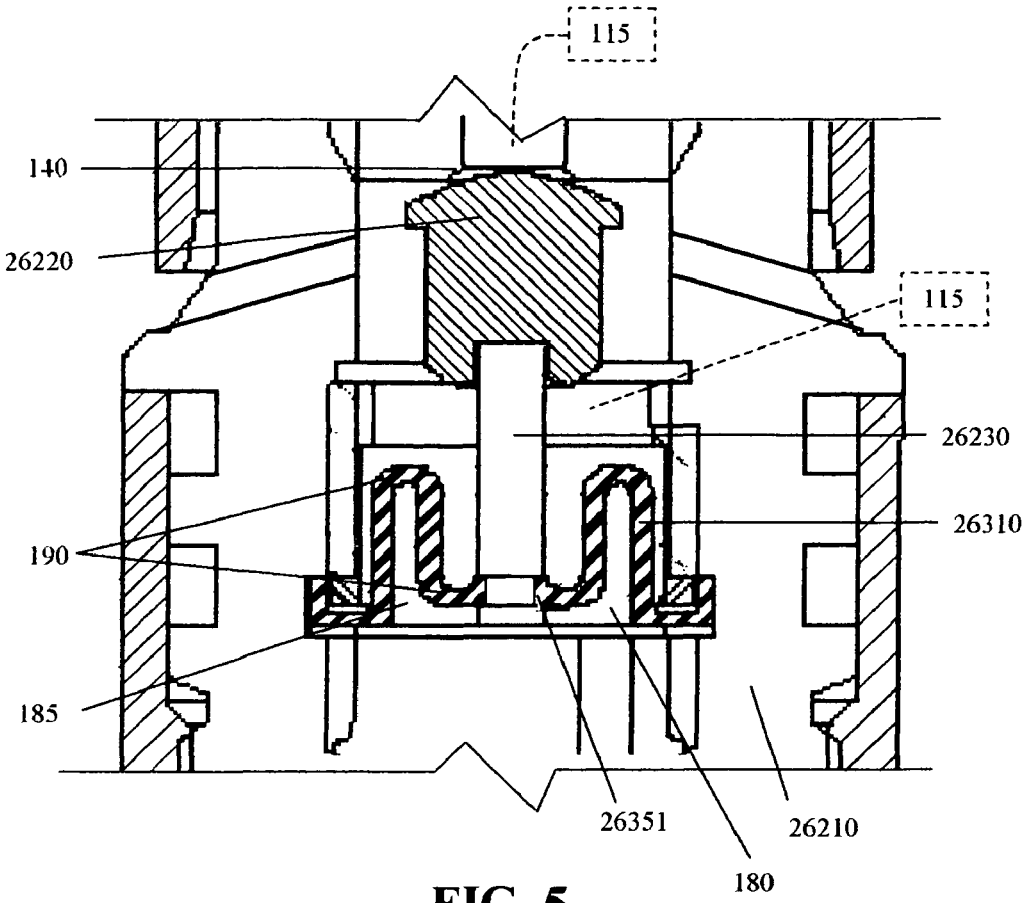
FIG. 5 describes the bellows operation.

Referring to FIG. 5, an embodiment of the bellows [26310] includes sealing a portion of the surface of the front pilot shaft [26230] engaging around a pilot shaft land [26351] and the interior of the hollow magnetic pressure cup [26210]. Sealing of the bellows [26310] keeps drilling mud [115] from entering the bellows chamber [185] and intermingling with the inner magnet chamber lubricating fluid [180] when the pilot [26220] is moved to an open position off the pilot seat [140]. Another embodiment is to allow the bellows [26310] to move linearly, concurrent with the front pilot shaft [26230]. The design of the bellows [26310] interacting with the front pilot shaft [26230] and the bellows chamber [185] allow the bellows [26310] to conform to the space constraints of the bellows chamber [185] providing flexible sealing without the bellows [26310] being displaced by the drilling mud [115]. It was also found that the double loop [190] configuration of bellows [26310] consumes much less energy than previous designs thereby reducing the overall consumption of energy. Energy consumption is also reduced by pre-filling the bellows chamber [185] with appropriate lubricating fluid [180]. This allows for reduction of pressure differential on both sides of the bellows [26310]. The smaller pressure differential enhances performance by the bellows [26310] and minimizes wear and energy consumption. The lubricating fluid [180] may be petroleum, synthetic or bio-based and should exhibit compression characteristics similar to hydraulic fluid. The double loop [190] configuration of the bellows is designed to minimize energy consumption.

Figure 6:
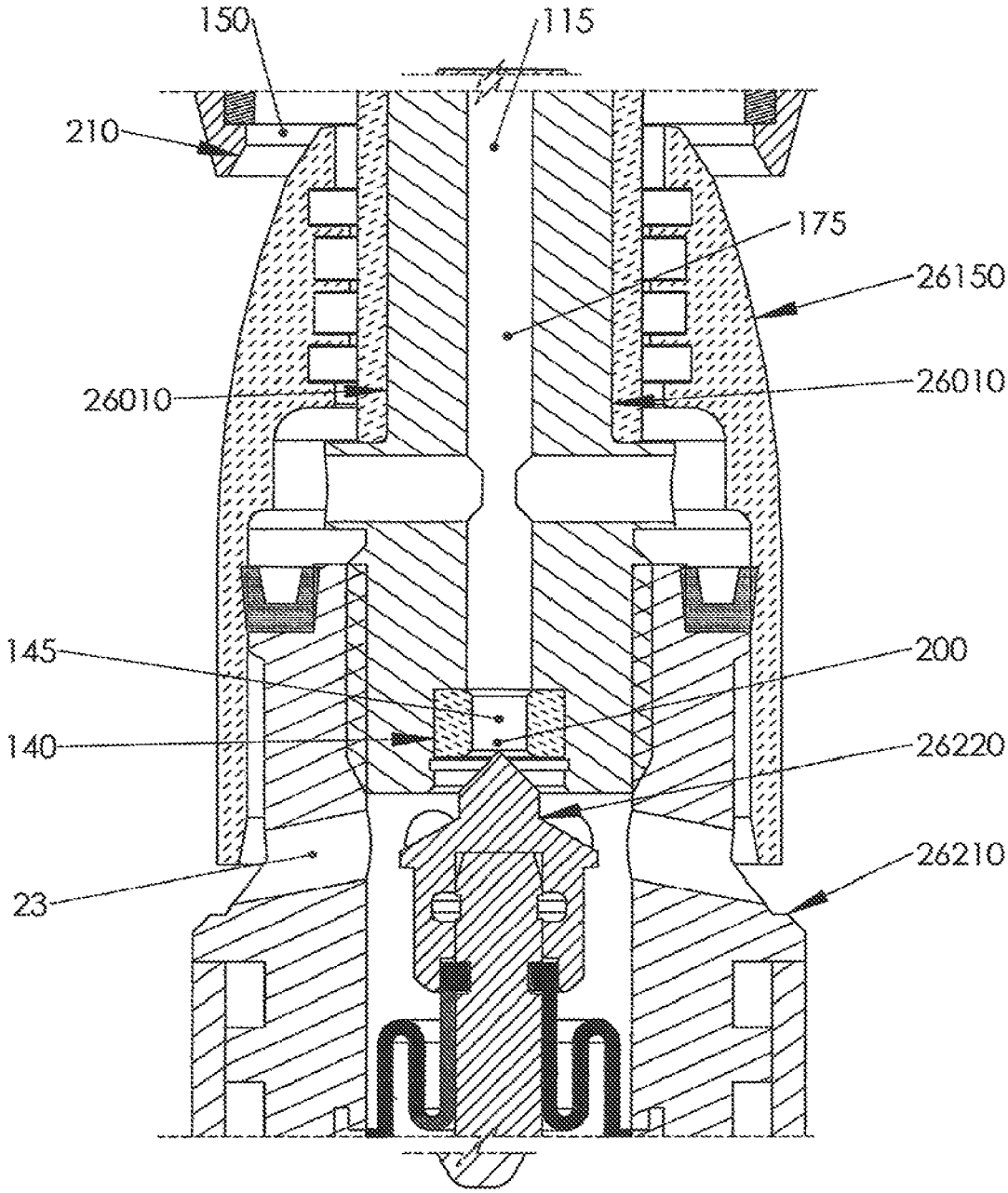
FIG. 6 describes the guide pole channel and orifice chamber.

FIG. 6 shows another embodiment of the present disclosure pertaining to the configuration showing the guide pole [26010], the guide pole channel [175] and orifice chamber [200] in the proximity of the pilot seat [140] and pilot seat orifice [145] When the pilot [26220] is in contact with the pilot seat [140] the flow throttling device [26150] moves toward the flow throttling device seat [210]. Inversely, when the pilot [26220] is not contacting the pilot seat [140] the flow throttling device [26150] withdraws from the flow throttling device seat [210]. The pressure differential between the drilling mud [115] pressure and the orifice chamber [200] moves the flow throttling device [26150] more rapidly, enabling a more forceful restriction of the flow throttling device orifice [150] and a more defined pulse and therefore clearer signals which are more easily interpreted. FIG. 6 also shows the magnetic pressure cup [26210] comprised of a non-magnetic material which is above and below the connecting channels [23].

What is claimed is:

1. An apparatus for generating pressure pulses in a drilling fluid, flowing within a drill string, comprising: a pulse generating device longitudinally and axially positioned within an annular drill collar flow channel such that said drilling fluid flows through said annular drill collar flow channel and said drilling fluid is guided into two sets of selectively reversible flow, upper and lower flow connecting channels, wherein said connecting channels are connected to an inner flow channel and said annular drill collar flow channel, and wherein said annular drill collar flow channel is acted upon by one or more flow throttling device(s) thereby transmitting signals and generating pulses via a pilot actuator assembly including a pilot, a pilot bellows, a pilot seat, a pilot seat orifice, flow throttling device(s), a sliding pressure chamber, and a pulser guide pole, wherein said upper and lower inner flow connecting channels provide for reversal of flow and wherein said pilot seals a middle inner flow channel from said lower inner flow channel and such that said flow throttling device(s) and said pilot are capable of bi-directional axial movement along or within said guide pole and said device utilizes a turbine residing near and within proximity of a flow diverter that diverts drilling mud in said annular flow channel into and away from turbine blades such that the force of the drilling mud causes said turbine blades and said turbine to rotationally spin around a coil assembly wherein said coil assembly that generates electrical power for operating a motor and other operating equipment wherein said motor comprises a drive shaft centrally located between said motor and a magnetic pressure coupling wherein said motor and said coupling are mechanically coupled such that said motor rotates said magnetic pressure coupling outer magnets and moves said pilot actuator assembly wherein said magnetic coupling is formed by a location external and internal to a magnetic pressure cup where outer magnets are placed in proper relation to inner magnets, said inner magnets located in a position inside said magnetic pressure cup, said coupling allowing for translating rotational motion of said motor and said outer magnets into linear motion of said inner magnets via a magnetic polar interaction, wherein linear motion of said inner magnets move said pilot actuator assembly by linearly moving said pilot into said pilot seat, closing said pilot seat orifice, lifting said flow throttling device(s) into a flow throttling orifice and thereby generating a pulse wherein further rotation of said motor drive shaft and said outer magnets move said pilot actuator assembly and said pilot away from said pilot seat causing said flow throttling device(s) to move away from said flow throttling orifice, thereby ending the positive pulse.

2. The apparatus of claim 1, wherein said motor is connected to a drive shaft through a mechanical device including a worm gear, barrel cam face cam, or other mechanical means for converting the rotational motion of said motor into linear motion to propel said pilot actuator assembly.

3. The apparatus of claim 1, wherein said apparatus includes a pulser guide pole capable of providing a path for said pilot and said flow throttling device(s) for operation in a bi-directional axial movement.

4. The apparatus of claim 1, wherein said pilot actuator assembly is also comprised of a rear pilot shaft, front pilot shaft, as well as a pilot.

5. The apparatus of claim 1 wherein the differential pressure created is minimal in that a slight force acting on a small cross-sectional area of a pilot seat defines a pressure that is required to either engage or disengage said pilot.

6. The apparatus of claim 1, wherein said motor may be synchronous, asynchronous or stepper and is activated to fully rotate or to rotate incrementally in various degrees depending on wellbore conditions or the observed signal intensity and/or duration of drilling.

7. The apparatus of claim 1, wherein said device utilizes a turbine residing near and within proximity of a flow diverter that diverts drilling mud in said annular flow channel into and away from turbine blades such that the force of the drilling mud causes said turbine blades and said turbine to rotationally spin around a coil assembly and wherein said turbine resides within said annular flow channel of a flow guide and wherein said annular flow channel has diverting vanes that direct flow of drilling mud through and around a surface of said turbine.

8. The apparatus of claim 1, wherein said turbine includes a turbine shroud comprising turbine magnets that rotate with the motion of said turbine around said coil assembly causing electrical power to be generated and allowing for decreased battery requirements, a decrease in cost of said battery, decreased operational downtime, and subsequently decreased cost of said apparatus.

9. The apparatus of claim 1, wherein energy consumption may also be further reduced by prefilling the bellows chamber with a lubricating fluid, gel or paste.

10. The apparatus of claim 1, wherein said turbine blades outside diameters around a pulser housing is smaller than a flow guide extension inner diameter, thereby allowing said turbine to be removed concurrently with said pulser housing.

11. The apparatus of claim 1, wherein said apparatus for generating pulses includes allowing a bellows to move linearly, concurrent with said pilot actuator assembly, wherein the design of said bellows interacts with said pilot actuator assembly and a bellows chamber allowing said bellows to conform to the space constraints of said bellows chamber providing flexible sealing without said bellows being displaced by the pressure differential created by the drilling fluid.

12. The apparatus of claim 1, wherein said bellows includes a double loop configuration designed for said flexible sealing thereby requiring less energy consumption during displacement of said bellows.

13. The apparatus of claim 1, wherein said pulse in said drilling mud is sensed by said instrumentation located uphole and wherein said pulse is communicated optionally with wireless devices, to a computer with a programmable controller for interpretation.

14. A method for generating pressure pulses in a drilling fluid, flowing within a drill string, comprising: a pulse generating device longitudinally and axially positioned within an annular drill collar flow channel such that said drilling fluid flows through said annular drill collar flow channel and said drilling fluid is guided into two sets of selectively reversible flow, upper and lower flow connecting channels, wherein said connecting channels are connected to an inner flow channel and said annular drill collar flow channel, and wherein said annular drill collar flow channel is acted upon by one or more flow throttling devices thereby transmitting signals, and generating pulses via a pilot actuator assembly including a pilot, a pilot bellows, a pilot seat, a pilot seat orifice, flow throttling device(s), a sliding pressure chamber, and a pulser guide pole, wherein said upper and lower inner flow connecting channels provide for reversal of flow and wherein said pilot seals a middle inner flow channel from said lower inner flow channel and such that said flow throttling device(s) and said pilot are capable of bi-directional axial movement along or within said guide pole and said device utilizes a turbine residing near and within proximity of a flow diverter that diverts drilling mud in said annular flow channel into and away from turbine blades such that the force of the drilling mud causes said turbine blades and said turbine to rotationally spin around a coil assembly wherein said coil assembly that generates electrical power for operating a motor and other operating equipment wherein said motor comprises a drive shaft centrally located between said motor and a magnetic pressure coupling wherein said motor and said coupling are mechanically coupled such that said motor rotates said magnetic pressure coupling outer magnets and moves said pilot actuator assembly wherein said magnetic coupling is formed by a location external and internal to a magnetic pressure cup where outer magnets are placed in proper relation to inner magnets, said inner magnets located in a position inside said magnetic pressure cup, said coupling allowing for translating rotational motion of said motor and said outer magnets into linear motion of said inner magnets via a magnetic polar interaction, wherein linear motion of said inner magnets move said pilot actuator assembly by linearly moving said pilot into said pilot seat, closing said pilot seat orifice, lifting said flow throttling device(s) into a flow throttling orifice and thereby generating a pulse wherein further rotation of said motor drive shaft and said outer magnets move said pilot actuator assembly and said pilot away from said pilot seat causing said flow throttling device(s) to move away from said flow throttling orifice, thereby generating another pulse.

15. The method of claim 14, wherein said motor is connected to a drive shaft through a mechanical device including a worm gear, barrel cam face cam, or other mechanical means for converting the rotational motion of said motor into linear motion to propel said pilot actuator assembly.

16. The method of claim 14, wherein said apparatus includes a pulser guide pole capable of providing a path for said pilot and said flow throttling device(s) for operation in a bi-directional axial movement.

17. The method of claim 14, wherein said pilot actuator assembly is also comprised of a rear pilot shaft, front pilot shaft, as well as a pilot.

18. The method of claim 14, wherein the differential pressure created is minimal in that a slight force acting on a small cross-sectional area of a pilot seat defines a pressure that is required to either engage or disengage said pilot.

19. The method of claim 14, wherein said motor may be synchronous, asynchronous, or stepper and is activated to fully rotate or to rotate incrementally in various degrees depending on wellbore conditions or the observed signal intensity and/or duration of drilling.

20. The method of claim 14, wherein said method utilizes a turbine residing near and within proximity of a flow diverter that diverts drilling mud in said annular flow channel into and away from turbine blades such that the force of the drilling mud causes said turbine blades and said turbine to rotationally spin around a coil assembly and wherein said turbine resides within said annular flow channel of a flow guide and wherein said annular flow channel has diverting vanes that direct flow of drilling mud through and around a surface of said turbine.

21. The method of claim 14, wherein said turbine includes a turbine shroud comprising turbine magnets that rotate with the motion of said turbine around said coil assembly causing electrical power to be generated and allowing for decreased battery requirements, a decrease in cost of said battery, decreased operational downtime, and subsequently decreased cost of said apparatus.

22. The method of claim 14, wherein energy consumption is further reduced by prefilling a bellows chamber with a lubricating fluid, gel or paste.

23. The method of claim 14, wherein said turbine blades outside diameters around a pulser housing is smaller than a flow guide extension inner diameter, thereby allowing said turbine to be removed concurrently with said pulser housing.

24. The method of claim 14, wherein said apparatus for generating pulses includes allowing a bellows to move linearly, concurrent with said pilot actuator assembly, wherein the design of said bellows interacts with said pilot actuator assembly and a bellows chamber allowing said bellows to conform to the space constraints of said bellows chamber providing flexible sealing without said bellows being displaced by the pressure differential created by the drilling fluid.

25. The method of claim 14, wherein said bellows includes a double loop configuration designed for said flexible sealing thereby requiring less energy consumption during displacement of said bellows.

26. The method of claim 14, wherein said pulse in said drilling mud is sensed by said instrumentation located within an uphole device and wherein said pulse is communicated optionally with wireless devices, to a computer with a programmable controller for interpretation.

27. A system for generating pressure pulses in a drilling fluid, flowing within a drill string, comprising: a pulse generating device longitudinally and axially positioned within an annular drill collar flow channel such that said drilling fluid flows through said annular drill collar flow channel and said drilling fluid is guided into two sets of selectively reversible flow, upper and lower flow connecting channels, wherein said connecting channels are connected to an inner flow channel and said annular drill collar flow channel, and wherein said annular drill collar flow channel is acted upon by one or more flow throttling devices thereby transmitting signals, and generating pulses via a pilot actuator assembly including a pilot, a pilot bellows, a pilot seat, a pilot seat orifice, flow throttling devices, a sliding pressure chamber, and a pulser guide pole, wherein said upper and lower inner flow connecting channels provide for reversal of flow and wherein said pilot seals a middle inner flow channel from said lower inner flow channel and such that said flow throttling devices and said pilot are capable of bi-directional axial movement along or within said guide pole and said device utilizes a turbine residing near and within proximity of a flow diverter that diverts drilling mud in said annular flow channel into and away from turbine blades such that the force of the drilling mud causes said turbine blades and said turbine to rotationally spin around a coil assembly wherein said coil assembly that generates electrical power for operating a motor and other operating equipment wherein said motor comprises a drive shaft centrally located between said motor and a magnetic pressure coupling wherein said motor and said coupling are mechanically coupled such that said motor rotates said magnetic pressure coupling outer magnets and moves said pilot actuator assembly wherein said magnetic coupling is formed by a location external and internal to a magnetic pressure cup where outer magnets are placed in proper relation to inner magnets, said inner magnets located in a position inside said magnetic pressure cup, said coupling allowing for translating rotational motion of said motor and said outer magnets into linear motion of said inner magnets via a magnetic polar interaction, wherein linear motion of said inner magnets move said pilot actuator assembly by linearly moving said pilot into said pilot seat, closing said pilot seat orifice, lifting said flow throttling devices into a flow throttling orifice and thereby generating a pulse wherein further rotation of said motor drive shaft and said outer magnets move said pilot actuator assembly and said pilot away from said pilot seat causing said flow throttling device(s) to move away from said flow throttling orifice, thereby ending the positive pulse.

28. The system of claim 27, wherein said outer magnets move said pilot actuator assembly and said pilot away from said pilot seat causing said flow throttling device to move into said flow throttling orifice, thereby generating a negative pulse.

29. The system of claim 27 wherein said motor is connected to a drive shaft through a mechanical device including a worm gear, barrel cam face cam, or other mechanical means for converting the rotational motion of said motor into linear motion to propel said pilot actuator assembly.

30. The system of claim 27, wherein said apparatus includes a pulser guide pole capable of providing a path for said pilot and said flow throttling device for operation in a bi-directional axial movement.

31. The system of claim 27, wherein said pilot actuator assembly is also comprised of a rear pilot shaft, front pilot shaft, as well as a pilot.

32. The system of claim 27, wherein the differential pressure created is minimal in that a slight force acting on a small cross-sectional area of a pilot seat defines a pressure that is required to either engage or disengage said pilot.

33. The system of claim 27, wherein said motor may be synchronous, asynchronous, or stepper and is activated to fully rotate or to rotate incrementally in various degrees depending on wellbore conditions or the observed signal intensity and/or duration of drilling.

34. The system of claim 27, wherein said method utilizes a turbine residing near and within proximity of a flow diverter that diverts drilling mud in said annular flow channel into and away from turbine blades such that the force of the drilling mud causes said turbine blades and said turbine to rotationally spin around a coil assembly and wherein said turbine resides within said annular flow channel of a flow guide and wherein said annular flow channel has diverting vanes that direct flow of drilling mud through and around a surface of said turbine.

35. The system of claim 27, wherein said turbine includes a turbine shroud comprising turbine magnets that rotate with the motion of said turbine around said coil assembly causing electrical power to be generated and allowing for decreased battery requirements, a decrease in cost of said battery, decreased operational downtime, and subsequently decreased cost of said apparatus.

36. The system of claim 27, wherein energy consumption is further reduced by prefilling a bellows chamber with a lubricating fluid, gel or paste.

37. The system of claim 27, wherein said turbine blades outside diameters round a pulser housing is smaller than a flow guide extension inner diameter, thereby allowing said turbine to be removed concurrently with said pulser housing.

38. The system of claim 27, wherein said apparatus for generating pulses includes allowing a bellows to move linearly, concurrent with said pilot actuator assembly, wherein the design of said bellows interacts with said pilot actuator assembly and a bellows chamber allowing said bellows to conform to the space constraints of said bellows chamber providing flexible sealing without said bellows being displaced by the pressure differential created by the drilling fluid.

39. The system of claim 27, wherein said bellows includes a double loop configuration designed for said flexible sealing thereby requiring less energy consumption during displacement of said bellows.

40. The system of claim 27, wherein said pulse in said drilling mud is sensed by said instrumentation located uphole and wherein said pulse is communicated optionally with wireless devices, to a computer with a programmable controller for interpretation.

41. The system of claim 27, wherein said higher pressure creates a more discernable pulse with a flow throttling device when a pilot moves away from said pilot seat thereby permitting flow of drilling fluid through said pilot orifice or moving said pilot toward said pilot seat thereby closing said pilot orifice, wherein said pressure differential between the drilling fluid pressure and an orifice chamber moves said flow throttling device rapidly, thereby enabling forceful restriction of said flow throttling device orifice and little or no noise in a signal-to-noise ratio and wherein said pulses are extremely reproducible with corresponding signals that are readily defined uphole.

42. Two or more apparatuses for generating pressure pulses in a drilling fluid, flowing within a drill string, comprising: a pulse generating device longitudinally and axially positioned within an annular drill collar flow channel such that said drilling fluid flows through said annular drill collar flow channel and said drilling fluid is guided into two sets of selectively reversible flow, upper and lower flow connecting channels, wherein said connecting channels are connected to an inner flow channel and said annular drill collar flow channel, and wherein said annular drill collar flow channel is acted upon by one or more flow throttling devices thereby transmitting signals, and generating pulses via a pilot actuator assembly including a pilot, a pilot bellows, a pilot seat, a pilot seat orifice, flow throttling devices, a sliding pressure chamber, and a pulser guide pole, wherein said upper and lower inner flow connecting channels provide for reversal of flow and wherein said pilot seals a middle inner flow channel from said lower inner flow channel and such that said flow throttling devices and said pilot are capable of bi-directional axial movement along or within said guide pole and said device utilizes a turbine residing near and within proximity of a flow diverter that diverts drilling mud in said annular flow channel into and away from turbine blades such that the force of the drilling mud causes said turbine blades and said turbine to rotationally spin around a coil assembly wherein said coil assembly that generates electrical power for operating a motor and other operating equipment wherein said motor comprises a drive shaft centrally located between said motor and a magnetic pressure coupling wherein said motor and said coupling are mechanically coupled such that said motor rotates said magnetic pressure coupling outer magnets and moves said pilot actuator assembly wherein said magnetic coupling is formed by a location external and internal to a magnetic pressure cup where outer magnets are placed in proper relation to inner magnets, said inner magnets located in a position inside said magnetic pressure cup, said coupling allowing for translating rotational motion of said motor and said outer magnets into linear motion of said inner magnets via a magnetic polar interaction, wherein linear motion of said inner magnets move said pilot actuator assembly by linearly moving said pilot into said pilot seat, closing said pilot seat orifice, lifting said flow throttling devices into a flow throttling orifice and thereby generating a pulse wherein further rotation of said motor drive shaft and said outer magnets move said pilot actuator assembly and said pilot away from said pilot seat causing said flow throttling device(s) to move away from said flow throttling orifice, thereby ending the positive pulse.

* * * * *